US012686902B2

(12) United States Patent
Burley et al.

(10) Patent No.: US 12,686,902 B2
(45) Date of Patent: Jul. 21, 2026

(54) PROCESSING METHOD

(71) Applicant: Rio Tinto Technological Resources Inc., South Jordan, UT (US)

(72) Inventors: Adam James Burley, South Jordan, UT (US); Javiera Del Pilar Alcayaga Zúñiga, South Jordan, UT (US); Yure Anton Mladinic Muñoz, South Jordan, UT (US)

(73) Assignee: Rio Tinto Technological Resources Inc., South Jordan, UT (US)

( * ) Notice: Subject to any disclaimer, the term of this patent is extended or adjusted under 35 U.S.C. 154(b) by 594 days.

(21) Appl. No.: 18/018,732

(22) PCT Filed: Jul. 30, 2021

(86) PCT No.: PCT/US2021/043878
§ 371 (c)(1),
(2) Date: Jan. 30, 2023

(87) PCT Pub. No.: WO2022/026817
PCT Pub. Date: Feb. 3, 2022

(65) Prior Publication Data

US 2023/0295768 A1 Sep. 21, 2023

Related U.S. Application Data

(63) Continuation of application No. 16/944,379, filed on Jul. 31, 2020, now Pat. No. 11,286,540.

(51) Int. Cl.
*C22B 15/00* (2006.01)
*C22B 1/00* (2006.01)
(Continued)

(52) U.S. Cl.
CPC ..... *C22B 15/0067* (2013.01); *C22B 1/005* (2013.01); *C22B 1/14* (2013.01); *C22B 3/06* (2013.01)

(58) Field of Classification Search
CPC ..... C22B 15/0067; C22B 1/005; C22B 1/14; C22B 3/06
See application file for complete search history.

(56) References Cited

U.S. PATENT DOCUMENTS 3,753,691 A 8/1973 Grover et al.
4,060,464 A 11/1977 Fahlstrom et al.
(Continued)

FOREIGN PATENT DOCUMENTS

CA 2374509 A1 11/2000
CL 199902905 8/2000
(Continued)

OTHER PUBLICATIONS

Uhrie, John L., "Pyrite as a stockpile leach-aid", Proceedings of Copper 99-Cobre 99 International Conference, vol. IV—Hydrometallurgy of Copper, The Minerals, Metals & Materials Society (1999), pp. 481-490.
(Continued)

*Primary Examiner* — Ricardo D Morales
(74) *Attorney, Agent, or Firm* — Banner & Witcoff, Ltd.

(57) ABSTRACT

A method of processing a pyrite-containing slurry is disclosed. The method includes removing pyrite from the pyrite-containing slurry and forming (i) an inert stream and (ii) a pyrite-containing material, with the pyrite-containing slurry including tailings from a tailings dam or an ore processing plant. The method also includes leaching a metal sulfide-containing material and the pyrite-containing material with a leach liquor and microbes. A method of leaching a metal sulfide-containing material is also disclosed. A flotation circuit for an ore processing plant for a metal sulfide-containing material is also disclosed.

13 Claims, 2 Drawing Sheets

(51) Int. Cl.

| | |
|---|---|
| ***C22B 1/14*** | (2006.01) |
| ***C22B 3/06*** | (2006.01) |

(56) References Cited

U.S. PATENT DOCUMENTS

| | | | | |
|---|---|---|---|---|
| 5,171,428 | A | 12/1992 | Beattie et al. | |
| 5,232,490 | A | 8/1993 | Bender et al. | |
| 5,316,751 | A | 5/1994 | Kingsley et al. | |
| 5,676,733 | A | 10/1997 | Kohr | |
| 6,036,025 | A | 3/2000 | Clark et al. | |
| 6,110,253 | A | 8/2000 | Kohr et al. | |
| 6,482,373 | B1 | 11/2002 | Hannaford et al. | |
| 6,926,753 | B2 | 8/2005 | Faine et al. | |
| 7,491,372 | B2 | 2/2009 | Faine et al. | |
| 7,575,622 | B2 | 8/2009 | Crundwell et al. | |
| 7,799,295 | B2 | 9/2010 | Dreisinger et al. | |
| 7,846,233 | B2 | 12/2010 | Dixon et al. | |
| 8,012,238 | B2 | 9/2011 | Kohr et al. | |
| 8,252,086 | B2 | 8/2012 | Seed et al. | |
| 8,273,237 | B2 | 9/2012 | Marsden et al. | |
| 8,277,539 | B2 | 10/2012 | Dixon et al. | |
| 8,388,728 | B2 | 3/2013 | Hollitt et al. | |
| 8,491,701 | B2 | 7/2013 | Uhrie et al. | |
| 8,821,613 | B2 | 9/2014 | Ji et al. | |
| 9,346,062 | B2 * | 5/2016 | Gorain | B03D 1/002 |
| 10,258,996 | B2 | 4/2019 | Gorain | |
| 10,323,296 | B2 | 6/2019 | Ponce Beoutis et al. | |
| 10,526,681 | B2 | 1/2020 | Chaiko et al. | |
| 10,563,287 | B2 | 2/2020 | Hackl et al. | |
| 11,236,407 | B1 | 2/2022 | Fennel et al. | |
| 11,286,540 | B2 | 3/2022 | Burley et al. | |
| 2002/0194963 | A1 * | 12/2002 | Kohr | C22B 1/00 75/744 |
| 2003/0013166 | A1 | 1/2003 | Kohr | |
| 2009/0019970 | A1 | 1/2009 | Ritchie et al. | |
| 2009/0074607 | A1 | 3/2009 | Hillier et al. | |
| 2009/0293680 | A1 | 12/2009 | Ritchie et al. | |
| 2011/0150729 | A1 | 6/2011 | Liu | |
| 2012/0118110 | A1 | 5/2012 | Urie et al. | |
| 2013/0291686 | A1 | 11/2013 | Du Plessis et al. | |
| 2014/0127094 | A1 | 5/2014 | Eaton | |
| 2014/0127789 | A1 | 5/2014 | Fitzmaurice et al. | |
| 2015/0027901 | A1 | 1/2015 | Theodore et al. | |
| 2015/0068956 | A1 | 3/2015 | Mashevskiy et al. | |
| 2015/0225809 | A1 | 8/2015 | Robertson et al. | |
| 2015/0329936 | A1 | 11/2015 | Kelso | |
| 2016/0138128 | A1 | 5/2016 | Nicolay et al. | |
| 2017/0028410 | A1 | 2/2017 | Anderson et al. | |
| 2019/0127822 | A1 | 5/2019 | Hackl et al. | |
| 2019/0127833 | A1 | 5/2019 | Shyam et al. | |
| 2023/0392232 | A1 | 12/2023 | Fennel et al. | |

FOREIGN PATENT DOCUMENTS

| | | | |
|---|---|---|---|
| CL | 200001292 | | 11/2000 |
| CL | 200801940 | | 3/2013 |
| CL | 202201505 | | 2/2022 |
| CL | 202201488 | | 3/2022 |
| CL | 20230295 | | 12/2023 |
| CN | 1475585 | A | 2/2004 |
| CN | 103173614 | A | 6/2013 |
| CN | 104017997 | A | 9/2014 |
| CN | 105648213 | A | 6/2016 |
| CN | 110119153 | A | 8/2019 |
| GB | 1404244 | A | 8/1975 |
| JP | S589942 | A | 1/1983 |
| JP | 2008302356 | A | 12/2008 |
| PE | 20010310 | A1 | 3/2001 |
| PE | 20140641 | A1 | 6/2014 |
| WO | 0071763 | A1 | 11/2000 |
| WO | 2011/059380 | A1 | 5/2011 |
| WO | 2014169325 | A1 | 10/2014 |

OTHER PUBLICATIONS

Nov. 16, 2020—(US) Non-final Office Action—U.S. Appl. No. 16/944,379.

Feb. 17, 2021—(US) Final Office Action—U.S. Appl. No. 16/944,379.

Jul. 21, 2021—(US) Non-final Office Action—U.S. Appl. No. 16/944,379.

International Search Report and Written Opinion for PCT/US2021/043869, Dec. 30, 2021, 21 pages.

International Search Report and Written Opinion for PCT/US2021/043878, Dec. 30, 2021, 20 pages.

International Preliminary Report on Patentability for PCT/US2021/043878, Nov. 17, 2022, 6 pages.

Petersen, J. (2016). Heap leaching as a key technology for recovery of values from low-grade ores—A brief overview. Hydrometallurgy, 165, 206-212.

Acar, S., Brierley, J. A., & Wan, R. Y. (2005). Conditions for bioleaching a covellite-bearing ore. Hydrometallurgy, 77(3-4), 239-246.

Jul. 16, 2025—1st Office Action—Chinese Patent Application No. 2021-80055970.X.

Jun. 16, 2025—2nd Office Action—Japanese Patent Application No. 2023-506288.

Mar. 3, 2023—(EP) Extended European Search Report—App 21849519.0.

* cited by examiner

PROCESSING METHOD

CROSS-REFERENCE TO RELATED APPLICATIONS

This application is a U.S. National Stage application under 35 U.S.C. § 371 of International Application PCT/US2021/043878 (published as WO 2022/026817A1), filed on Jul. 30, 2021, which claims the benefit of priority to U.S. application Ser. No. 16/944,379, filed on Jul. 31, 2020, now U.S. Pat. No. 11,286,540, and each of these prior applications is hereby incorporated by reference in its entirety.

TECHNICAL FIELD

The present invention relates to a method of processing, for example by beneficiating, a pyrite-containing slurry.

The present invention relates particularly, although by no means exclusively, to a method of processing, for example by beneficiating, a pyrite-containing slurry, by removing pyrite from the slurry and using the removed pyrite in downstream method steps.

The present invention relates particularly, although by no means exclusively, to a method of processing, for example by beneficiating, a pyrite-containing slurry in the form of tailings from a processing plant for recovering metal from a metal sulfide-containing material, such as a metal sulfide mineral, by removing pyrite from the tailings and using the removed pyrite in downstream method steps.

A particular application of the invention is removing pyrite from a pyrite-containing slurry from a tailings dam or a processing plant for recovering copper from a copper sulfide-containing material, such as a copper sulfide mineral.

A particular application of the invention is using the removed pyrite in downstream method steps to recover a valuable metal, such as copper, from a metal sulfide-containing material, such as a metal sulfide mineral, such as a copper sulfide mineral.

The present invention also relates to a heap leaching method that is characterized by leaching a heap of agglomerates containing a metal sulfide-containing material, such as a metal-containing sulfide mineral, such as a copper sulfide mineral, with the agglomerates produced at least in part from a pyrite-containing material to recover a valuable metal from the sulfide-containing material.

The present invention also relates to a heap that is characterized by the heap containing agglomerates containing a metal sulfide-containing material, such as a metal sulfide mineral, such as a copper sulfide mineral, that are produced at least in part from a pyrite-containing material.

The present invention also relates to a flotation circuit for an ore processing plant for a metal sulfide-containing material.

The present invention also relates to an ore processing plant for a metal sulfide-containing material.

BACKGROUND ART

The technical field of the invention described above is relevant to the production of a metal, such as copper or nickel or zinc or cobalt from a metal sulfide-containing material, such as a metal sulfide mineral, in a mined material.

The term "mined material" is understood herein to include material that is mined and transferred from the mine (a) directly to downstream processing operation to recover a metal from the material or (b) to a stockpile.

The following description of the invention focuses on copper as one example of a metal, with the copper being in a copper sulfide-containing material, such as a copper sulfide mineral.

Copper is an increasingly important metal for the transition to a low carbon-based global economy.

Current wet processing plants for recovering copper from copper sulfide-containing materials, such as copper-containing sulfidic ores and concentrates, such as wet processing plants that include flotation circuits, typically produce large volumes of tailings in the form of aqueous slurries of particulates, typically fines but may include coarse particles, containing small concentrations of copper in copper sulfide-containing materials, such as copper sulfide minerals.

The following description of tailings is in the context of tailings (a) in a tailings dam that stores tailings from an ore processing plant or (b) directly from a tailings stream of the ore processing plant for copper sulfide-containing materials, such as copper sulfide-containing ores containing copper sulfide minerals.

Tailings are typically stored in dams. Typically, the dams are substantial in size and the dam capacity increases as mining continues.

Tailings and tailings dams often present significant environmental and safety risks during the lives of mines.

There are substantial issues involved in maintaining tailings dams during the lives of mines and remediating tailings dams at the end of the lives of mines. The suspended solids take time, often considerable time, to settle to facilitate safe disposal of the solids. In addition, there are potential issues with structural integrity of tailings dams. There are known de-watering technologies for reducing the volumes of tailings, but these technologies add cost and complexity to mining operations.

From time to time, there are catastrophic collapses of tailings dams that have caused loss of life and considerable damage to areas downstream of the dams.

Also, there are concerns about mines taking the necessary steps to ensure the structural integrity of dam walls to minimize the risk of collapse.

Also, tailings often contain contaminants, either directly or via reactions, which present challenges for mine remediation.

For example, tailings often contain considerable concentrations of pyrite, which poses a potential environmental hazard because the tailings can oxidize to produce an acidic effluent that requires treatment, for example, by neutralizing the acidity, before the tailings can be discharged.

It is important to note that removal of contaminants is not an answer if the cost is prohibitive and/or the contaminants, once removed from tailings, remain as contaminants, albeit in another medium that has to be stored/contained in some way.

Therefore, contaminants such as pyrite, add a layer of complexity to processing tailings.

The invention provides a method that makes it possible to process the pyrite-containing tailings beneficially.

The above description and the following description focus on tailings from wet processing plants for copper-containing ores. The invention also extends to tailings derived from processing ores containing other metals, such as cobalt, nickel and zinc.

The above description is not an admission of the common general knowledge in Australia or elsewhere.

SUMMARY OF THE DISCLOSURE

The invention is based on a realization that it is possible to remove pyrite from a pyrite-containing slurry, such as pyrite-containing tailings from a tailings dam or an ore processing plant for a metal sulfide-containing material, such as a metal sulfide-containing ore containing metal sulfide minerals, and to use the pyrite to contribute to removing a metal, such as copper or nickel or zinc or cobalt, from the metal sulfide-containing material in a way that takes advantage of the acid and heat-generation capacity of pyrite and in so doing also reduces the environmental impact of pyrite.

One particular application of the invention of interest to the applicant that the applicant has recognised is well-suited to the use of pyrite that is removed from pyrite-containing tailings is a heap leaching application for a mined material that contains a metal, such as copper or nickel or zinc or cobalt. The applicant has found that, in this application, pyrite can be used beneficially, by way of example, in agglomerates of the mined material and pyrite that are subsequently formed into a heap and leached with a leach liquor and microbes.

As noted above, the term "mined material" is understood herein to include material that is mined and transferred from the mine (a) directly to downstream processing operation to recover a metal from the material or (b) to a stockpile and processed later.

Therefore, the invention is more than removing pyrite from one waste stream, namely a pyrite-containing slurry. The invention does this and therefore improves the pyrite-containing slurry from an environmental perspective. However, the invention also processes pyrite removed from the slurry in a way that makes it possible to use the pyrite beneficially in a downstream process and reduces the net environmental impact of the pyrite.

In broad terms the invention provides a method of removing copper from a low-grade copper-containing material having copper sulfide minerals that comprises:

(a) obtaining a pyrite-containing slurry from a tailings dam or a tailings stream of an ore processing plant;

(b) removing pyrite from the pyrite-containing slurry by floating pyrite-containing material and forming (i) an inert stream and (ii) a stream containing the pyrite-containing material;

(c) mixing a low-grade copper-containing material having copper sulfide minerals and the pyrite-containing material, and (d) leaching copper from the copper-containing material with a leach liquor and microbes, wherein the pyrite in the pyrite-containing material generates acid and heat that facilitates leaching copper from the copper-containing material, and wherein the microbes oxidize ferrous iron to ferric iron.

The step of removing pyrite from the pyrite-containing slurry may include selecting operating conditions so that pyrite particles have a required particle size distribution for the leaching step (d).

The step of removing pyrite from the pyrite-containing slurry may include separating larger particles of pyrite-containing material from the remaining pyrite-containing slurry, reducing the size of the larger particles in a size reduction circuit and returning the reduced-sized particles to the size separation step.

In broad terms the invention provides a method of processing a pyrite-containing slurry that comprises:

(a) removing pyrite from a pyrite-containing slurry and forming an inert stream as described herein and a pyrite-containing material; and (b) using the pyrite-containing material in a downstream leach step in which pyrite in the pyrite-containing material generates acid and heat that facilitates leaching a metal, such as copper or nickel or zinc or cobalt, from a metal sulfide-containing material, such as a mined material, such as an ore.

More particularly, the invention provides a method of processing a pyrite-containing slurry that comprises:

(a) removing pyrite from a pyrite-containing slurry and forming an inert stream as described herein and a pyrite-containing material, with the pyrite-containing slurry including tailings from a tailings dam or an ore processing plant; and (b) leaching a metal sulfide-containing material and the pyrite-containing material with a leach liquor and microbes and removing metal from the metal sulfide-containing material and forming a pregnant leach liquor containing metal, with the pyrite in the pyrite-containing material generating acid and heat that facilitates leaching metal from the metal sulfide-containing material, and with the microbes oxidising ferrous iron to ferric iron.

The term "inert" as used herein in relation to an inert stream is understood to mean that the stream is less reactive than the input slurry to the method in terms of the amount of pyrite in the stream.

The term "pyrite-containing slurry" as used herein is understood to mean any slurry that contains pyrite in amounts that present an environmental hazard if untreated/unmanaged.

The term "ore processing plant" is understood herein to mean any suitable plant for recovering a metal from an ore.

The word "ore" is understood herein to mean a natural rock or sediment that contains one or more valuable minerals, typically containing valuable metals, that can be mined, treated and sold at a profit.

The metal sulfide-containing material may be derived from any suitable mined material.

The Above-Described Method has the Following Advantages:

The method makes it possible to process tailings that contain pyrite and thereby reduce the volumes of existing tailings dams. This is an important environmental outcome, typically involving minimal use of resources.

The removal of pyrite from a pyrite-containing slurry from a tailings dam or an ore processing plant, in accordance with the invention produces two "products", which are useful as a consequence of the invention.

One product is an inert stream. As defined above, "inert" means that the stream is less reactive than the input slurry to the method in terms of the amount of pyrite in the inert stream. This is beneficial because pyrite in tailings is an environmental problem because pyrite makes the tailings "acid generating" and this is an issue for disposal of the tailings. The method provides an opportunity to produce an output that is environmentally safe for use in downstream applications, such as in copper or nickel or zinc or cobalt ore processing plants (in the case of an aqueous portion of the inert stream) and as ground cover/fill material (in the case of a solid portion of the inert stream). With regard to the ground cover/fill material opportunity, this is possible in view of the reduction or substantial elimination altogether of the capacity of the solid portion to generate acidic drainage.

The second product is a pyrite-containing material that is used beneficially as a source of pyrite in downstream method steps of the invention and, as a consequence, minimises the adverse environmental impact of pyrite. For example, the pyrite-containing material of the second product can be used beneficially in method steps for recovering a metal, such as copper or nickel or zinc or cobalt, from a metal sulfide-containing material, such as via heap leaching of a metal sulfide-containing material, for example waste rock, such as low-grade metal sulfide-containing material, such as a low-grade copper sulfide-containing material. In this regard, the acid and heat generating capacity of pyrite is an advantage in heap leaching. For example, pyrite can reduce the amount of added acid that is required in the leach liquor. In addition, pyrite oxidation is a highly exothermic reaction and the heat that is generated enables elevated temperature leaching which results in more rapid and complete extraction of metals during heap leaching. It is noted that any metal, such as copper or nickel or zinc or cobalt, in the pyrite-containing material is a bonus—it is taken into the heap with pyrite and can be recovered in the heap leaching step.

The method can be operated with readily-available and tried and tested equipment.

The method makes it possible to process what has been previously classified as metal sulfide-containing waste materials, such as tailings and waste rock, and reduce the environmental impact of these materials as well as optimising the recovery of value from the originally-mined material.

It is noted that the term "low grade" as used in the phrase "low grade copper sulfide-containing material" mentioned above is understood herein to be a term that is dependent on currently available technology and the current price of copper, and that material currently considered "low grade" may be considered valuable material in the future depending on technological developments and the future price of copper.

The pyrite removal step (a) may include processing the pyrite-containing slurry by any method that recovers pyrite from the slurry.

The pyrite removal step (a) may include processing the pyrite-containing slurry by any method that recovers and concentrates pyrite from the slurry.

The pyrite removal step (a) may include floating pyrite-containing material in the pyrite-containing slurry and producing (i) the inert stream as one flotation output and (ii) the pyrite-containing material, such as a pyrite-containing concentrate stream, as another flotation output.

The pyrite removal step (a) may include, before the above flotation step, a size separation step on the pyrite-containing slurry, such as via cyclones or other suitable classification devices, that for example separates larger particles in the pyrite-containing material from the pyrite-containing slurry, with the remaining pyrite-containing slurry being transferred to the flotation step.

The term "cyclone" is understood herein to describe a device that can classify, separate or sort particles in a liquid suspension based on the ratio of their centripetal force to fluid resistance. This ratio is high for dense (where separation by density is required) and coarse (where separation by size is required) particles, and low for light and fine particles.

The pyrite removal step (a) may include reducing the size of the larger particles in the pyrite-containing material in a size reduction circuit and returning the reduced-sized particles to the size separation step.

The pyrite removal step (a) may include selecting the operating conditions for the size separation step so that pyrite particles in the pyrite-containing material in the remaining pyrite-containing slurry have a required particle size distribution for downstream processing of the tailings, for example in a heap leaching operation.

The pyrite removal step (a) may include thickening and/or filtering the pyrite-containing material stream and de-watering the stream and forming a pyrite-containing concentrate.

The method may include any suitable downstream processing steps for the inert stream produced in the pyrite removal step (a).

The processing steps may include using an aqueous portion of the inert stream as a source of water in processing plants for recovering copper or nickel or zinc or cobalt from ores containing at least one of these metals.

A solid portion of the inert stream may be used as cover/fill material to cap tailings dams and to generally fill voids, for example, voids in waste rock dumps by mixing the tailings with the waste rock prior to disposal.

The solid portion may also be used in construction materials such as to make concrete or bricks.

Also, the solid portion may also be used to sequester $CO_2$ from the atmosphere as carbonate minerals.

The leach step (b) may include any suitable leach step that leaches a metal, such as copper or nickel or zinc or cobalt, from the metal sulfide-containing material.

Typically, pyrite is 1-10 wt. % of the total mass of the copper sulfide-containing material and the pyrite-containing material.

The method may include mixing together the metal sulfide-containing material and the pyrite-containing material before the leaching step (b).

The method may include mixing together the metal sulfide-containing material and the pyrite-containing material and forming agglomerates of these materials before the leaching step (b).

By Way of Example, the Leaching Step (b) May Include:

i. mixing the pyrite-containing material and the metal sulfide-containing material, such as copper sulfide-containing material, and forming agglomerates;

ii. heap leaching the metal, such as copper, from a heap of the agglomerates and producing a pregnant leach liquor containing the metal, such as copper, in solution; and iii. recovering the metal, such as copper from the pregnant leach liquor.

The pyrite particles in the pyrite-containing material may have a particle size of $P_{80}$ of 1 mm or a value <1 mm.

The pyrite particles in the pyrite-containing material may have a particle size of $P_{80}$ of 250 μm or a value <250 μm.

The agglomeration step (i) may be any suitable step for agglomerating the pyrite-containing material and the copper sulfide-containing material.

The agglomeration step (i) may include mixing and agglomerating the pyrite-containing material and the metal sulfide-containing material, such as copper sulfide-containing material.

The mixing step may be carried out before the agglomerating step.

The mixing and the agglomerating steps may be carried out simultaneously.

The metal sulfide-containing material may be derived from any suitable mined material.

The metal may be copper.

In that event, by way of example, the metal sulfide-containing material may be a copper sulfide-containing material.

The copper sulfide-containing material may be any suitable copper sulfide-containing material, such as a copper sulfide mineral.

One example of the copper sulfide-containing material is rocks that contain low concentrations of copper and, for example, may be regarded as waste rock.

The copper sulfide-containing material may be in the form of as-mined material or waste stockpiles of copper sulfide-containing material having low grades, i.e. low concentrations, of copper in the material, noting the above explanation of the term "low grade" as used in the phrase "low grade copper sulfide-containing material".

In other words, the copper sulfide-containing material may be as-mined material or from stockpiles that are considered to be too low in grade to be economically processed in flotation and other wet processing systems for recovering copper from copper-containing ores and concentrates.

More particularly, the copper sulfide-containing material may be as-mined material or from stockpiles that are too low-grade to be economically processed by any other processing method, including heap leaching.

In the context of the three preceding paragraphs, the term "low concentrations of copper" is understood to mean an average copper concentration of ≤1.5% by weight, typically ≤1.2 wt. %, more typically ≤1.0 wt. %, even more typically ≤0.7 wt. %, even more typically ≤0.5 wt. %, even more typically ≤0.3 wt. %, even more typically ≤0.1 wt. %.

The invention also provides a heap leaching method for a mined material that contains a metal, such as copper or nickel or zinc or cobalt, in a metal sulfide-containing material that is characterized by:

(a) leaching a heap of agglomerates produced from (i) a pyrite-containing material produced from a pyrite-containing slurry, such as pyrite-containing tailings from a tailings dam or an ore processing plant, and (ii) a mined material that contains a metal, such as copper or nickel or zinc or cobalt, in a metal sulfide-containing material, with a leach liquor and microbes, with the pyrite in the pyrite-containing material generating acid and heat that facilitates leaching metal from the mined material, and with the microbes oxidising ferrous iron to ferric iron; and (b) collecting a pregnant leach liquor containing the metal in solution from the heap.

The heap leaching method also comprises recovering the metal from the pregnant leach liquor.

The invention also provides a heap that leaches a metal, such as copper or nickel or zinc or cobalt, from a metal sulfide-containing material in a mined material, the heap comprising:

(a) a heap of agglomerates produced from (i) a pyrite-containing material produced from a pyrite-containing slurry, such as pyrite-containing tailings from a tailings dam or an ore processing plant, and (ii) a mined material that contains a metal, such as copper or nickel or zinc or cobalt, in a metal sulfide-containing material; and (b) a system that (i) supplies a leach liquor and microbes to the heap so that the leach liquor flows downwardly though the heap and leaches the metal from the mined material and (ii) collects a pregnant leach liquor containing the metal in solution from the heap, with the pyrite generating acid and heat in the heap that facilitates leaching metal from the mined material, and with the microbes oxidising ferrous iron to ferric iron.

The pyrite may be 1-10 wt. % of the total mass of the agglomerates.

In Broad Terms, the Invention Also Provides a Method of Mining Comprising:

(a) mining a metal sulfide-containing ore, such as a copper-sulfide containing ore;

(b) processing the metal sulfide-containing ore in an ore processing plant and producing a pyrite-containing slurry; and (c) the above-described method of processing the pyrite-containing slurry.

The present invention also provides a flotation circuit for an ore processing plant for a metal sulfide-containing material, the flotation circuit including:

(a) a mill feed flotation circuit for producing a tailings stream and a concentrate stream from a mill feed, with the tailings stream comprising a metal sulfide-containing material; and (b) a pyrite flotation circuit for producing a pyrite concentrate stream, i.e. a pyrite-containing slurry, and a tailings stream.

The pyrite flotation circuit may be configured to process the pyrite concentrate stream, i.e. a pyrite-containing slurry, in accordance with the above-described method of processing a pyrite-containing slurry.

The mill feed flotation circuit may be any suitable circuit.

The mill feed flotation circuit may include a rougher/scavenger cell and a bulk cleaner cell. These may be standard rougher/scavenger and bulk cleaner cells. These may be existing cells in an ore processing plant. They may be cells in a greenfield plant.

The rougher/scavenger and the bulk cleaner cells may be configured so that: (i) the rougher/scavenger cell processes the mill feed and produces a first tailings stream and a concentrate stream and (ii) the bulk cleaner cell processes the concentrate stream and produces a second tailings stream and another concentrate stream and transfers the other concentrate stream for further processing, such as metal recovery, and the second tailings stream to the pyrite flotation circuit for processing in that circuit.

The metal sulfide-containing material may be a copper sulfide-containing material, such as a copper sulfide-containing mineral.

The mill feed may be any suitable particle size distribution of the metal sulfide-containing material.

The ore processing plant may include any suitable upstream comminution circuits for producing the mill feed and downstream recovery and tailings storage of other options.

The present invention also provides an ore processing plant for a metal sulfide-containing material comprising the above flotation circuit.

The ore processing plant may also include any suitable upstream comminution circuits and downstream recovery and tailings storage and/or treatment options.

The metal sulfide-containing material may be a copper sulfide-containing material, such as a copper sulfide-containing mineral.

The present invention also provides a heap leaching operation for leaching a metal, such as copper or nickel or zinc or cobalt, from a metal sulfide-containing material in a mined material, the heap leaching operation comprising:

(a) a heap of agglomerates of the metal sulfide-containing material and pyrite, such as pyrite derived from the above-described method of processing a pyrite-containing slurry; and (b) a system that (i) supplies leach liquor and microbes to the heap so that the leach liquor flows downwardly though the heap and leaches the metal from the metal sulfide-containing material and (ii) collects a pregnant leach liquor containing the metal in solution from the heap, with the pyrite generating acid and heat in the heap that facilitates leaching the metal from the metal sulfide-containing material, with pyrite being in or derived from a slurry containing pyrite, such as mine tailings, and with the microbes oxidising ferrous iron to ferric iron.

The metal sulfide-containing material may be derived from any suitable mined material.

As noted above, the term "mined material" is understood herein to include material that is mined and transferred from the mine (a) directly to downstream processing operation to recover a metal from the material or (b) to a stockpile and processed later.

BRIEF DESCRIPTION OF THE DRAWINGS

The invention is described further below by way of example only with reference to the following Figures, of which.

DESCRIPTION OF EMBODIMENTS

One embodiment of the method of processing, for example by beneficiating, a pyrite-containing slurry in the form of tailings from a tailings dam or an ore processing plant of a mine in accordance with the invention shown in FIG. 1 removes pyrite from the tailings and produces an inert stream that is suitable for use in downstream applications and a pyrite-containing material that is used beneficially, as described below, in downstream heap leaching of a copper sulfide-containing material and, as a consequence, minimizes the adverse environmental impact of pyrite.

In other words, the embodiment produces two "products" from the pyrite-containing slurry.

It is understood that the invention is not confined to this embodiment and extends generally to a method of processing, for example by beneficiating, a pyrite-containing slurry, such as a pyrite-containing tailings produced in a mine, that comprises removing pyrite from the slurry and forming two "products" in the form of (a) an inert stream and (b) a pyrite-containing material, typically a solid material, such as a solid concentrate that can be used in an application other than downstream heap leaching of a copper sulfide-containing material.

It is noted that the pyrite-containing slurry may be any suitable pyrite-containing slurry, such as tailings, from an ore processing plant. Example 2 and FIG. 3 describe an embodiment of a flotation circuit in accordance with the invention for producing a suitable pyrite-containing slurry.

Figure 1:
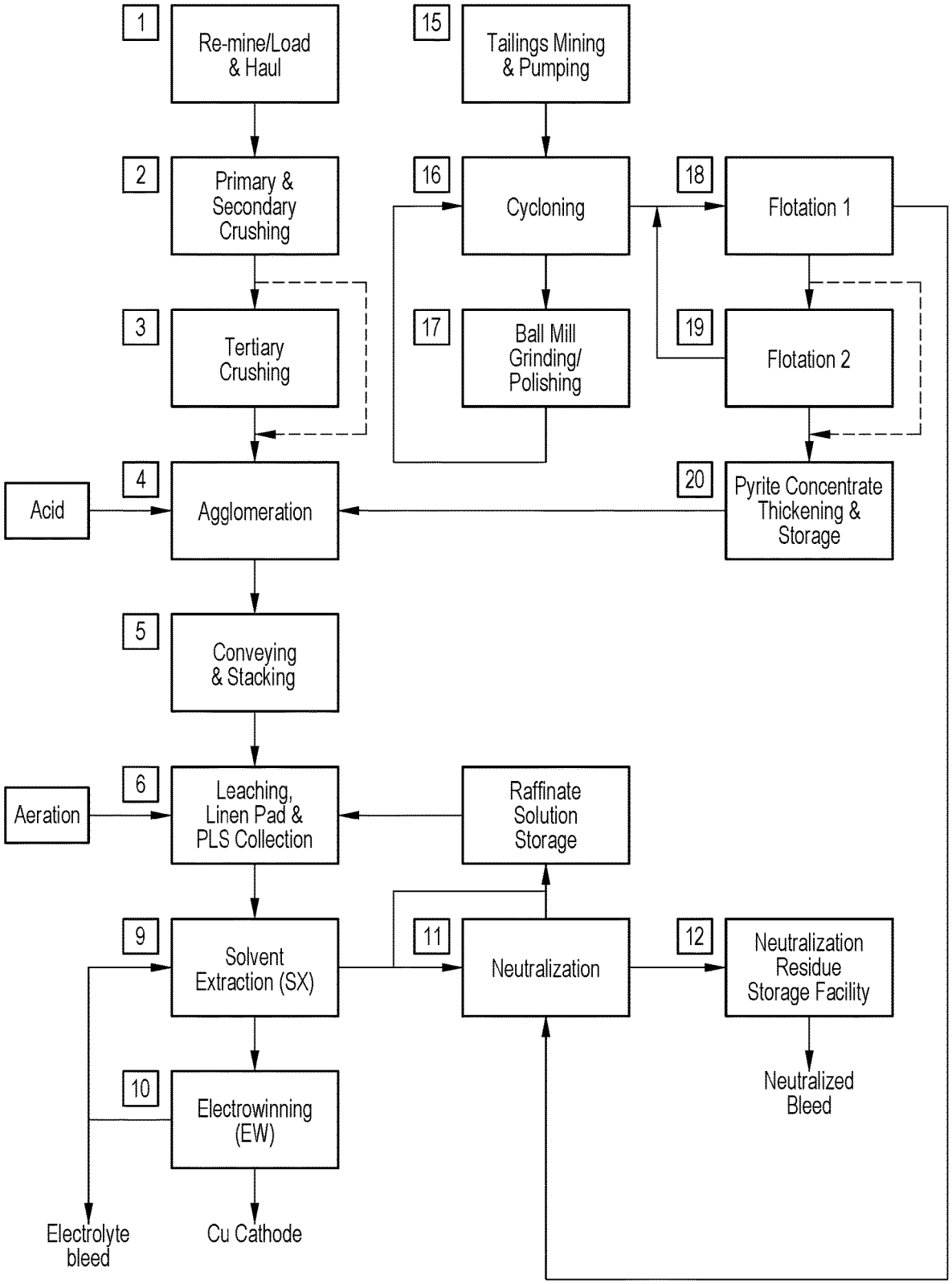
FIG. 1 is a flow sheet of one embodiment of a method of processing, for example by beneficiating, pyrite-containing tailings, i.e. a pyrite-containing slurry, and using the pyrite removed from the tailings in downstream heap leaching of a copper sulfide-containing material.

In general terms, the embodiment shown in FIG. 1 includes a method of removing copper from a low-grade copper-containing material having copper sulfide minerals, with the method including leaching the low-grade copper-containing material and pyrite and producing a pregnant leach liquor and recovering copper form the leach liquor, with the pyrite being produced from a pyrite-containing slurry.

In general terms, the embodiment shown in FIG. 1 is a method of mining comprising:

(a) mining and optionally stockpiling a copper sulfide-containing material, such as a copper sulfide-containing mineral;

(b) processing a copper sulfide-containing ore, as described herein, in the copper sulfide-containing material in an ore processing plant and (i) recovering copper and (ii) producing a pyrite-containing slurry a;

(c) processing the pyrite-containing slurry and producing pyrite; and (d) processing "non-economic", low-grade copper sulfide-containing material, as described herein, with pyrite in a heap leaching operation.

In more specific terms in relation to processing the pyrite-containing slurry and producing pyrite and downstream use of the pyrite, with reference to FIG. 1. the method includes the following steps:

(a) separation steps 15, 16, 17, 18, 19, 20 that process pyrite-containing tailings from a tailings dam or an ore processing plant (not shown in FIG. 1 but shown in part by way of example in FIG. 3) of the mine and produce two "products" in the form of (i) a solid pyrite-containing concentrate stream 20 and (a) an inert stream from the tailings;

(b) an agglomeration step 4 that mixes and agglomerates (i) the pyrite-containing concentrate stream 20 from the separation steps and (ii) at least one copper sulfide-containing solid material that has been processed in steps 1, 2, 3;

(c) a heap leach step 6 that leaches copper from copper sulfide-containing material in a heap of the agglomerates produced in the agglomeration step 4 and produces a pregnant leach liquor; and (d) copper recovery steps 9, 10 that recover copper from the pregnant leach liquor from the heap.

Separation Steps 15, 16, 17, 18, 19, 20 for Pyrite-Containing Tailings Typically, the tailings are an output of an ore processing plant for recovering copper from a copper sulfide-containing ore that contains copper sulfide-containing material, such as copper sulfide minerals.

The ore processing plant may be any suitable plant.

One example of an ore processing plant is one that includes comminution of mined ore involving a series of crushing and grinding stages and one or more than one flotation circuit for floating copper sulfide minerals from the comminuted ore (described above and in Example 2 as a "mill feed") and producing a valuable concentrate output and a tailings output (a pyrite-containing slurry).

Typically, the solids in the tailings are in the form of a slurry of (a) fines, with low concentrations of copper, typically less than 0.4 wt. %, more typically less than 0.3 wt. %, and (b) pyrite-containing particles suspended in water. Typically, these fines and pyrite-containing particles are slow to settle. The pyrite-containing particles may also contain some copper.

The tailings are transferred, for example by being pumped, from a tailings dam or other suitable source of tailings 15, such as directly from the ore processing plant, to a series of cyclones 16 or any other suitable size separation option that separates larger solids from the remaining fines-containing tailings and forms two separate streams.

The cyclones 16 may be any suitable cyclones.

The larger solids from the cyclones 16 are processed in a size reduction circuit, such as a milling/grinding/polishing circuit 17, that reduces the particle sizes of the larger solids.

The output of this circuit is returned to the cyclones 16 for further processing in the cyclones.

The operating conditions of the cyclones 16 are selected so that the pyrite-containing particles in the remaining tailings have a required particle size distribution for the heap leach step 5. In this regard, typically pyrite-containing particles in the remaining tailings have a particle size of $P_{80}$ of 1 mm or a value <1 mm. More typically, pyrite particles in the remaining tailings have a particle size of $P_{80}$ of 250 μm or a value <250 μm.

The remaining tailings from the cyclones 16 are transferred to a $1^{st}$ flotation circuit 18 (described in Example 2 in relation to FIG. 3 as a "pyrite flotation cell") and are processed in the circuit. Suitable flotation reagents are added to the circuit as required. The operating conditions, including reagents, are selected to float pyrite-containing particles. Typically, these operating conditions will also float copper particles.

The underflow from the $1^{st}$ flotation circuit forms the abovementioned inert stream. As noted above, the term "inert" means that the stream is less reactive than the input slurry to the method in terms of the amount of pyrite in the stream. In the context of FIG. 1, this means that the underflow stream is less reactive than the pyrite-containing tailings supplied to the method in terms of the amount of pyrite in the stream. As noted above, this is beneficial because pyrite in tailings is an environmental problem because pyrite makes the tailings "acid generating tailings" and this is an issue for disposal of the tailings. The method provides an opportunity to produce an output that is environmentally safe for use in downstream applications, such as in copper ore processing plants, and can reduce the oxidant (ferric iron) requirements. The ferric iron (produced by microbial oxidation of the ferrous iron that dissolves from the pyrite concentrate and iron-bearing minerals in the waste rock) oxidizes the pyrite and the copper sulfide minerals. In the embodiment of FIG. 1, the underflow stream for the $1^{st}$ flotation circuit is transferred to a downstream neuralization step 11 described below.

Figure 3:
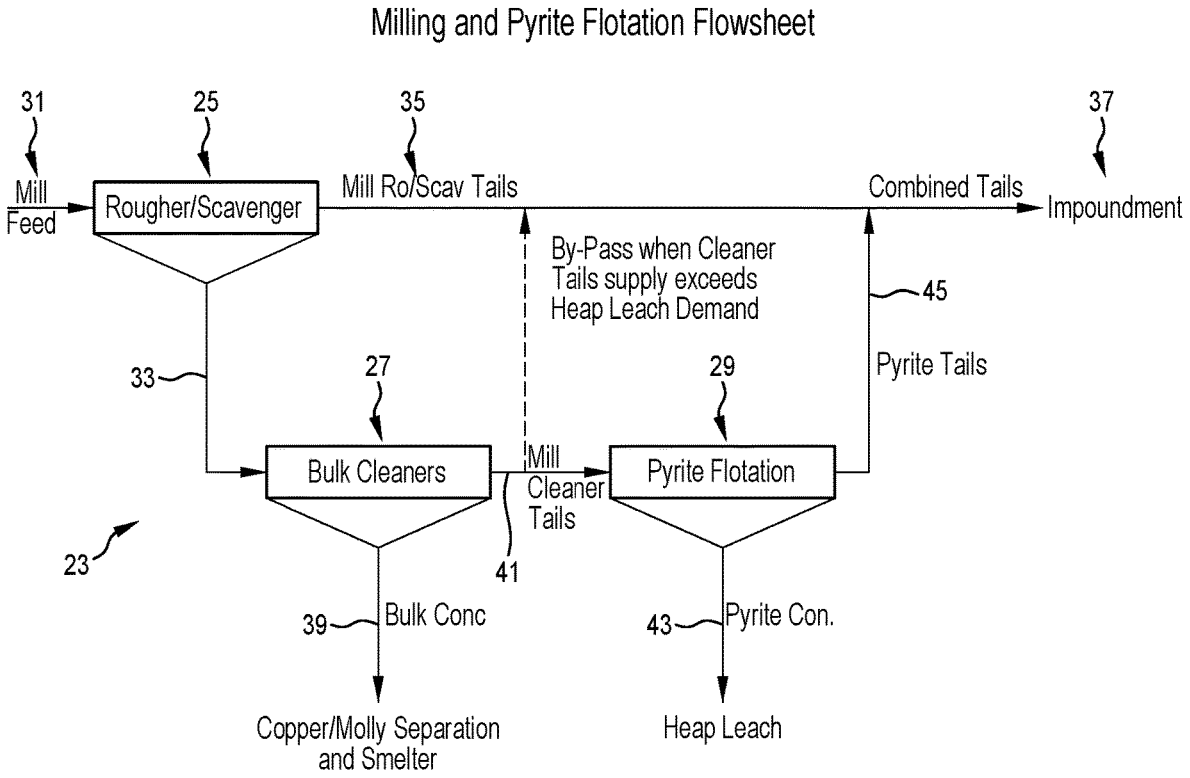
FIG. 3 is a flow sheet of one embodiment of a flotation circuit for an ore processing plant in accordance with the invention.

The overflow, i.e. floated, stream from the $1^{st}$ flotation circuit is transferred to and processed in a $2^{nd}$ flotation circuit 19 (described in Example 2 in relation to FIG. 3 as a "pyrite flotation cell").

Suitable flotation reagents are added to the $2^{nd}$ flotation circuit 19 as required. The operating conditions, including reagents are selected to float pyrite-containing particles. The underflow from the $2^{nd}$ flotation circuit is transferred back to the $1^{st}$ flotation circuit.

The pyrite-containing overflow from the $2^{nd}$ flotation circuit is transferred to thickeners 20 and de-watered and forms a pyrite-containing concentrate.

The pyrite-containing concentrate is transferred from the thickeners 20 to the agglomeration step 4 described below.

It is noted that, whilst the described embodiment has two flotation circuits 18, 19, the invention is not confined to this number of circuits.

It is also noted that, whist the described embodiment includes cyclones 16 and a milling/grinding/polishing circuit 17 and returns material to the cyclones 16, the invention is not confined to this arrangement.

For example, the combination of the cyclones 16 and the milling/grinding/polishing circuit 17 would not be necessary if the particle size distribution in the tailings supplied from the tailings dam or other suitable source of tailings 15 is suitable for downstream processing after the separation steps.

By way of further example, the combination of the cyclones 16 and the milling/grinding/polishing circuit 17 would not be necessary where there are downstream steps to optimise the particle size distribution of pyrite particles in the pyrite-containing concentrate.

Agglomeration Step 4

The Agglomeration Step 4 Agglomerates:

(a) the tailings-derived pyrite-containing concentrate described above; and (b) a copper sulfide-containing material produced in steps 2 and 3.

The copper sulfide-containing material in this embodiment of the method of the invention includes copper sulfide-containing waste rock and is discussed in the following section.

It is noted that the copper sulfide-containing material may be any suitable copper sulfide-containing material having regard to the characteristics, such as particle size distribution, of the tailings-derived concentrate and the requirements for downstream processing of the agglomerates.

The agglomeration step 4 may be any suitable agglomeration step using any suitable apparatus, such as agglomeration drums.

By way of example, required ratios of the pyrite-containing concentrate and the copper sulfide-containing material are added to a mixing device and are mixed together, with or without a binder, with or without an acid, and with or without added water, and with or without recycled leach solution.

The required ratios depend on factors such as the amount of pyrite in the rock. Typically, a broad pyrite concentration range for the mixed product is 1-10 wt. % pyrite.

The selection of the binder and the acid and the addition of water and/or recycled leaching solution are a function of a number of factors, including the characteristics of the pyrite-containing concentrate and the copper sulfide-containing feed materials and the required mechanical properties of the agglomerates.

The agglomeration step 4 may include any suitable protocol for adding and mixing the pyrite-containing concentrate, the copper sulfide-containing solid feed materials and the binder and water, if required.

The agglomerates are stored in a stack 5 and are transferred to the heap leach steps described below.

Processing the Copper-Containing Material Steps—1, 2, 3

In the flow sheet shown in FIG. 1, the copper sulfide-containing material is in the form of waste rock having low grades of copper that has been re-mined from stockpiles 1.

As noted above, currently, these stockpiles are considered too low-grade to be economically processed in flotation and other ore processing systems for recovering copper from copper sulfide-containing ores and concentrates.

As noted above, the invention is not confined to this source of copper sulfide-containing material.

For example, the copper sulfide-containing material may be material that is considered too low grade to be economically processed for recovering copper by known conventional methods in test work carried out on a section of a mine before being mined (for example by drilling and blasting) and then, after mining, is transferred directly from the mine (without being stockpiled) for processing in steps 2 and 3.

The stockpiled waste rock 1 is transported in suitable vehicles, such as haul trucks or front-end loaders, or on conveyor belts to comminution circuits and crushed and milled in primary, secondary and tertiary comminution circuits 2, 3 to the extent required to produce a suitable particle size distribution for the agglomeration step 4.

The comminution circuits 2, 3 may include single or multiple crushing steps delivering crushed copper-containing material to single or multiple milling and sizing steps to produce the comminution product stream having a desired particle size distribution for the agglomeration step 4.

The crushing steps 2, 3 may be carried out using a combination of gyratory, cone and high pressure grinding roll (HPGR) crushers (not shown in the Figures).

The resultant comminuted copper sulfide-containing material is transferred to the agglomeration step 4.

Heap Leach, Downstream Solvent Extraction, and Electrowinning Steps 5, 6, 9, 10, 11, 12

The agglomerates from the stack 5 and formed into a heap 6 of agglomerates on a leach pad.

The heap 6 may be any suitable heap construction and is provided with:

(a) a leach liquor storage and delivery system to supply leach liquor to an upper surface of the heap;

(b) a pregnant leach liquor collection system for collecting leach liquor containing copper in solution that is extracted from copper sulfide-containing materials in agglomerates in the heap; and (c) microbes (such as bacteria or archaea) or other suitable oxidants to oxidise ferrous iron to ferric iron, with the ferric iron being an oxidant in the leaching process.

The pregnant leach liquor is processed in a solvent extraction system 9 that extracts copper from the liquor in an organic medium and then strips copper from the organic medium and produces a copper-containing solution.

The copper-containing solution is transferred to an electrowinning plant 10 and copper is recovered from solution.

The raffinate from the solvent extraction system 9 is regenerated and returned to the heap as leach liquor. The leach liquor regeneration system includes a raffinate bleed limestone/lime neutralization step 11 to control the build-up of impurities, generating neutralized solids for separate impoundment in a neutralization residue storage facility 12 or possibly co-impoundment with tailings.

The pyrite-containing concentrate in the agglomerates provides valuable sources of acid and heat via the pyrite.

The acid-generating properties of the pyrite mean that the amounts of acid that have to be added to the leach liquor can be reduced to maintain a given leaching acid requirement.

In addition, the microbial oxidation of pyrite produces acid and heat, all of which are beneficial for heap leaching the copper sulfide-containing material.

Advantages of the Embodiment Shown in FIG. 1

The advantages of the above-described embodiment shown in FIG. 1, and the invention generally, include the following advantages:

The embodiment makes it possible to produce two output "products" from pyrite-containing tailings.

One product is an inert stream.

The second product is a pyrite concentrate that can be used beneficially in a downstream heap leaching method for a copper-containing material. In this application, the primary focus is on the beneficial use of pyrite to generate acid and heat in a heap to reduce the added acid requirements for heap leaching and to generate elevated temperatures which increase the rate and extent of copper extraction from the copper containing material.

The embodiment makes it possible to reduce the environmental impact of pyrite-containing tailings and to use at least the extracted pyrite beneficially.

The embodiment makes it possible to optimise the recovery of copper from a mined material at low cost, with minimal environmental impact and minimal use of resources.

The embodiment uses readily-available and tried and tested equipment.

Example 1

The applicant has carried out column bioleach tests to investigate the impact of pyrite augmentation on bioleaching of a copper ore.

The column bioleach tests evaluated copper extraction versus leaching time for (i) a sample of ore from a copper mine, (ii) the copper ore augmented with finely pulverised museum grade pyrite and (iii) the copper ore augmented with pyrite concentrate produced by flotation of tailings produced at the copper mine.

A sample of ore from a copper mine was crushed to <12 mm, with a $P_{80}$ of 9 mm and around 10 kg of this material was added to an agglomerating drum with water and concentrated sulfuric acid.

In tests with added pyrite, either nearly pure museum grade pyrite, or fine pyrite concentrate produced by flotation of tailings produced at a copper mine, was mixed with the ore in the agglomerating drum to increase, or augment, the pyrite content of the agglomerated material from 0.86 wt. % pyrite naturally present in the ore to 4.0% pyrite. Both pyrite samples used were very fine with a $P_{100}$ of 150 μm. The samples were subjected to elemental and mineralogical analysis.

It is noted that the term "museum grade pyrite" is understood herein to mean a pyrite content of greater than 90 wt %, typically greater than 95 wt %, typically greater than 97 wt %, or more typically greater than 99 wt %. Museum grade pyrite may have a silver content of less than 1 mg/kg, typically less than 0.5 mg/kg, typically less than 0.2 mg/kg, or more typically less than 0.1 mg/kg.

Table 1 summarises the elemental and mineralogical compositions of the ore, the museum grade pyrite and the pyrite concentrate used in the tests.

TABLE 1

Major elements and sulfide minerals in the ore and pyrite samples.

| Element or Mineral | Ore | Museum Grade Pyrite | Pyrite Concentrate |
|---|---|---|---|
| Copper, % | 0.63 | 0.15 | 1.1 |
| Iron, % | 1.19 | 46.1 | 41.1 |
| Sulfur, % | 0.90 | 52.9 | 47.4 |
| Silver, ppm | 1.20 | 0.05 | 14.2 |
| Chalcopyrite, % | 1.10 | 0.40 | 1.5 |
| Chalcocite, % | — | — | 0.18 |
| Covellite, % | 0.11 | — | 0.06 |
| Bornite, % | 0.11 | — | 0.53 |
| Nukundamite, % | 0.10 | — | 0.03 |
| Pyrite, % | 0.86 | 99 | 85 |

Once mixed, the agglomerated material was loaded into 1 m high, 0.1 m diameter columns and allowed to cure for 2-5 days at room temperature before leaching commenced. During leaching, the temperature of the columns was controlled at 50° C. using a heating jacket and the column was aerated at 0.102 $Nm^3$/h/tonne ore. The column was inoculated with ferrous iron-oxidising and sulfur-oxidising microorganisms and the irrigation solution, which initially contained 5 g/L ferric iron as ferric sulfate, was pumped into the top of the column through drippers, at 10 L/h/$m^2$, and collected at the base of the column.

The pH of the collected leach solution was adjusted to the target pH of 1.2 with sulfuric acid if required before recycling back to the top of the column. Solution samples were regularly taken for analysis of their metals and sulfate concentrations.

The irrigation solution had a sulfate concentration of about 20 g/L at the beginning of the leach. If the sulfate concentration in solution exceeded 120 g/L, due to addition of sulfuric acid and oxidation of the sulfide minerals, the solution was diluted to maintain a maximum of 120 g/L sulfate.

If the solution copper concentration exceeded 8 g/L, due to copper leaching, the solution was subjected to ion exchange to remove copper and reduce the solution copper concentration to maintain it at less than 8 g/L.

The column tests were under leach for 350 days. Upon completion of leaching, the columns were rinsed first with dilute sulfuric acid and then with water to remove dissolved metals and sulfate contained in the entrained leach solution. The columns were then emptied and the solids dried and assayed along with the final leach solution. Mass balances were conducted and the copper extraction reported on the basis of the calculated copper head assay.

Figure 2:
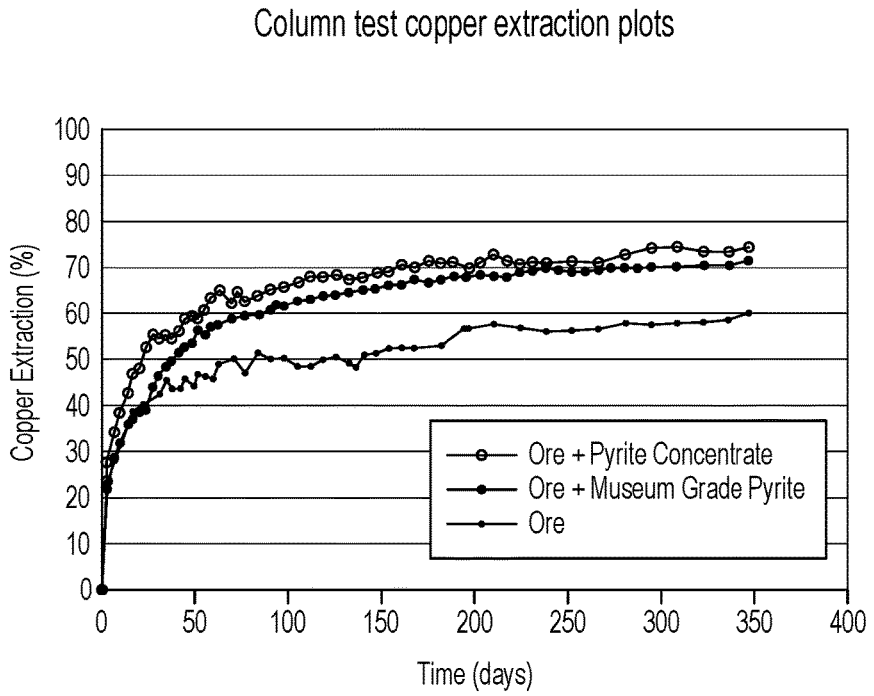
FIG. 2 is a graph of copper extraction versus leaching time for a series of column bioleach tests conducted on (i) a sample of ore from a copper mine, (ii) the copper ore augmented with finely pulverised museum grade pyrite and (iii) the copper ore augmented with pyrite concentrate produced by flotation of tailings produced at the copper mine.

FIG. 2 is a graph depicting copper extraction versus leaching time for the three column tests and Table 2 summarises the copper and sulfide mineral extractions achieved.

TABLE 2

Column test extraction results.

| Parameter | Ore | Ore + Museum Grade Pyrite | Ore + Pyrite Concentrate |
|---|---|---|---|
| Pyrite content, % | 0.86 | 4.0 | 4.0 |
| Silver content, g Ag/kg $CuFeS_2$ | 0.17 | 0.16 | 0.20 |
| Copper extraction, % | | | |
| Overall | 59.7 | 71.2 | 74.1 |
| From the −150 μm fraction | 87.1 | 90.2 | 92.0 |
| Chalcopyrite extraction, % | 63.2 | 62.0 | 70.5 |

TABLE 2-continued

Column test extraction results.

| Parameter | Ore | Ore + Museum Grade Pyrite | Ore + Pyrite Concentrate |
|---|---|---|---|
| Chalcocite extraction, % | — | — | 79.0 |
| Covellite extraction, % | 57.7 | 64.9 | 66.8 |
| Bornite extraction, % | 89.7 | 91.6 | 93.8 |
| Nukundamite extraction, % | 44.2 | 78.4 | 88.1 |
| Pyrite extraction, % | 50.0 | 90.2 | 89.4 |

The beneficial effect of augmenting the ore with pyrite on copper extraction is clearly evident from FIG. 2 and Table 2.

Copper extraction was increased by 11.5% and 14.4% by adding museum grade pyrite and pyrite concentrate respectively. The enhanced copper extraction is believed to be attributable to the increased availability of ferric iron provided by the oxidation and leaching of the added pyrite, which reacted rapidly due to its fine particle size ($P_{100}$ of 150 μm). This is evident from the pyrite extraction results shown in Table 2. Extraction of pyrite in the ore was only 50.0% whereas extraction of pyrite from the ore augmented with the museum grade pyrite and pyrite concentrate was much higher, reaching 90.2% and 89.4% respectively.

Notably, copper extraction was very high from the minus 150 μm fines fraction in all three tests; 87.1% in the test on the ore, 90.2% in the test on the ore augmented with museum grade pyrite, and 92.0% in the test on the ore augmented with pyrite concentrate. The results demonstrate that very high copper extraction was achieved from the copper minerals contained in the ore fines as well as the copper minerals in the two pyrite augments, both of which had a $P_{100}$ particle size of minus 150 μm. The natural silver content of the column feed samples, expressed in Table 2 as g Ag/kg $CuFeS_2$, is believed to have had a beneficial catalytic effect and enhanced the recovery of copper from chalcopyrite (as taught in International application PCT/AU2018/050316 (WO 2018/184071) in the name of the applicant), particularly from the chalcopyrite in the fines fractions.

Thus, the invention provides a means of achieving very high copper extraction from copper minerals contained in the pyrite augment as well has high copper extraction from copper minerals contained in an ore.

Example 2

The purpose of Example 2 was to show the effectiveness of removing pyrite from a pyrite-containing slurry produced in a flotation circuit in an ore processing plant.

FIG. 3 is a flow sheet of one embodiment of a flotation circuit 23 for an ore processing plant in accordance with the invention.

The ore processing plant may include any suitable upstream comminution circuits and downstream recovery and tailings storage or other options (not shown).

The flotation circuit 22 shown in FIG. 3 includes a rougher/scavenger cell 25 and a bulk cleaner cell 27. These may be standard rougher/scavenger and bulk cleaner cells. These may be existing cells in an ore processing plant. They may be cells in a greenfield plant.

The flotation circuit 22 shown in FIG. 3 also includes a pyrite flotation cell 29 of the type described above in relation to FIG. 1, noting that FIG. 1 includes two cells 18, 19 and FIG. 2 shows a single cell 29. It is noted that the invention extends to any suitable number of pyrite flotation cells, with size separation and re-grind options 16, 17 and other options for processing a feed material to the cells for example as illustrated in FIG. 1, as may be required.

In use, a mill feed 31 is transferred to the rougher/scavenger cell 25, and the cell produces a concentrate stream 33 and a first tailings stream 35. The mill feed 31 may be any suitable mill feed, produced for example by combinations of crushing and grinding and size separation steps, which may be existing comminution circuits in an ore processing plant or purpose-designed circuits in a greenfield plant.

The first tailings stream 35 is transferred to an impoundment location 37. This may be a tailings dam or other tailings treatment options.

The concentrate stream 33 from the rougher/scavenger cell 25 is transferred to the bulk cleaner cell 27, and the cell produces a plant concentrate stream 39 and a second tailings stream 41.

The plant concentrate stream 39 from the bulk cleaner cell 27 is transferred for recovery of copper and other metals such as molybdenum. The recovery options may be any suitable options.

The second tailings stream 41 from the bulk cleaner cell 27 is transferred to the pyrite flotation cell 29, and the cell produces a pyrite-containing concentrate stream 43 and a third tailings stream 45.

The first and third tailings streams 35, 45 and, optionally, a part of the second tailings stream 41, are transferred to the impoundment location, such as tailings storage or other tailings treatment options.

The pyrite-containing concentrate stream 43 is transferred for further processing, such as agglomeration, and use in the above-described heap leaching circuit as shown in FIG. 1.

The applicant carried out large-scale flotation testwork on a sample of a scavenger/cleaner tailings, i.e. the second tailings stream, in the pyrite flotation cell shown in FIG. 3. The results are described below.

Table 3 summarises the composition of the pyrite concentrate obtained from a feed of scavenger/cleaner tailings, i.e. the second tailings stream, in the pyrite flotation cell.

The table shows the effectiveness of recovering of pyrite (and copper minerals-which is a considerable advantage) in the pyrite concentrate stream (see rows 1-10) from tailings using flotation.

The process produced a pyrite concentrate at a grade of 83% pyrite, 2.2% Cu and a rougher/scavenger tails at a pyrite grade less than 0.8% pyrite.

TABLE 3

QEMSCAN bulk mineralogy of Cleaner Scavenger Tails sample (the second tailings stream 41) and Pyrite Concentrate from the pyrite fotation cell 29

| Product | Scav Cl Tails | Pyrite Con |
|---|---|---|
| Mineral | % | % |
| Chalcocite/Digenite | 0.04 | 0.30 |
| Covellite | 0.01 | 0.08 |
| Cu Oxides | 0.01 | 0.01 |
| Chalcopyrite | 0.16 | 1.42 |
| Bornite | 0.08 | 1.30 |
| Cu Arsenides | 0.01 | 0.03 |
| Nukundamite | *— | 0.02 |
| Other Cu Minerals | 0.13 | 0.31 |
| Cu Clays | 0.00 | 0.00 |
| Pyrite | 8.63 | 83.0 |
| Sphalerite | — | 0.02 |
| Sulphur | 0.03 | 0.16 |
| Molybdenite | 0.27 | 1.27 |
| Other Sulphides | 0.07 | 0.24 |
| Quartz | 45.2 | 5.82 |

TABLE 3-continued

QEMSCAN bulk mineralogy of Cleaner Scavenger Tails sample (the second tailings stream 41) and Pyrite Concentrate from the pyrite fotation cell 29

| Product | Scav Cl Tails | Pyrite Con |
|---|---|---|
| K-Feldspar | 20.2 | 1.10 |
| Muscovite | 2.27 | 0.17 |
| Plagioclase Feldspar | 1.85 | 0.03 |
| Scolecite | 0.01 | — |
| Biotite/Phlogopite | 8.71 | 0.91 |
| Chlorite_(K) | 0.05 | 0.01 |
| Chlorites | 0.81 | 0.05 |
| Talc | 0.54 | 1.32 |
| Garnet | 0.40 | — |
| Epidote | 0.07 | — |
| Amphibole | 1.28 | 0.18 |
| Pyroxene (Diopside) | 0.21 | 0.02 |
| Andalusite | — | — |
| Kaolinite (clay) | 1.40 | 0.12 |
| Pyrophyllite | 0.02 | — |
| Smectite | 2.25 | 0.08 |
| Spene | 0.05 | — |
| FeOx/Hydrox | 0.30 | 0.08 |
| Diaspore | 0.01 | — |
| Carbonates | 1.15 | 0.07 |
| Siderite | — | — |
| Jarosite | — | — |
| Alunite | 0.07 | 0.05 |
| Zircon | 0.03 | — |
| Rutile/Anatase | 0.27 | 0.15 |
| Phosphates | 0.66 | 0.08 |
| Ca-sulphate | 0.03 | 0.02 |
| Other Silicates | 0.75 | 0.20 |
| Others | 1.95 | 1.38 |
| Σ Clay | 3.67 | 0.20 |
| Σ Skarn | 3.66 | 1.66 |

Table 4 provides a summary of key results from the large-scale pyrite flotation testwork and shows that 78 wt. % of the pyrite originally contained in the tailings sample was recovered to the pyrite concentrate.

TABLE 4

Pyrite Balance from Flotation Tests

| | Combine pyrite balance T#4-T#7 | | | |
|---|---|---|---|---|
| | kg | wt. % | % pyrite | Pyrite dist % |
| Combine rougher (RO) + Scavenger concentrate | 138.7 | 6.76 | 45.8 | 78.1 |
| Scavenger Tails | 1912 | 93.24 | 0.9 | 21.9 |
| Head Calculated | 2051 | 100 | 4 | 100 |

A grab sample of pyrite flotation feed, i.e. the second tailings stream 41, and pyrite flotation cell tails, i.e. the third tailings stream 45, was subjected to Acid/Base Accounting (ABA) testing. A summary of results is shown in Table 5.

TABLE 5

ABA Tests on Pyrite Flotation Feed and Tails

| | % S = Sulfur | % C in CO3 | Calc AP | Calc NP | NNP | Ratio |
|---|---|---|---|---|---|---|
| Pyrite Flotation Feed | 1.2 | 0.23 | 33 | 16 | −17 | 0.48 |
| Pyrite Flotation Tails | 0.12 | 0.24 | 2.8 | 18 | 15.2 | 6.42 |

AP & NP units tons calcium carbonate equivalent per 1,000 tons of solids.

The ABA results indicate a reduction in pyrite reporting to the tails (lower AP), i.e. the second and third tailing streams, 41, 45. A negative NNP (net neutralisation potential) indicates that the pyrite flotation cell feed, i.e. the second tailings stream 41, is a net acid generator and the greater than 1 ratio (6.42) for the pyrite flotation cell tails, i.e. the third tailings stream 45, indicates that the inert stream (i.e. flotation tails) can be used as ground cover/fill material.

It is evident from the above that the flotation circuit shown in FIG. 3 is an effective circuit for producing a pyrite concentrate stream, i.e. pyrite containing slurry that can be used for example in the heap leaching operation described above in relation to FIG. 1.

Many modifications may be made to the flow sheet of FIG. 1 without departing from the spirit and scope of the invention.

By way of example, whilst the embodiment includes a "cycloning" step 16, the invention extends to the use of any suitable size separation step.

In addition, whilst the embodiment includes steps 1-3 to process waste rock to form the copper sulfide-containing material that is one feed for the agglomeration step 4, the invention is not confined to this combination of steps and the waste rock may be processed in any suitable steps to produce a suitable feed material for the agglomeration step 4.

In addition, whilst the embodiment is described in the context of recovering copper, it is noted that the invention is not confined to copper and extends to recovering metals such as nickel or zinc or cobalt from waste rock containing at least one of these metals in a metal-sulfide containing material.

In addition, whilst the embodiment focuses on tailings from wet processing plants for copper sulfide-containing ores, the invention also extends to tailings derived from processing ores containing other metals, such as cobalt, nickel and zinc.

The invention claimed is:

1. A method of processing a pyrite-containing slurry that comprises:

(a) removing pyrite from the pyrite-containing slurry and forming (i) an inert stream and (ii) a pyrite-containing material, with the pyrite-containing slurry including tailings from a tailings dam or an ore processing plant;

(b) mixing together a metal sulfide-containing material and the pyrite-containing material; and (c) leaching the metal sulfide-containing material and the pyrite-containing material with an acidic leach liquor and microbes and removing a metal from the metal sulfide-containing material and forming a pregnant leach liquor containing metal, with the pyrite in the pyrite-containing material generating acid and heat that facilitate leaching of the metal from the metal sulfide-containing material, and with the microbes oxidising ferrous iron to ferric iron, wherein the metal is copper, nickel, zinc, or cobalt.

2. The method defined in claim 1 wherein the pyrite removal step (a) includes floating the pyrite-containing material in the pyrite-containing slurry and producing (i) the inert stream as one flotation output and (ii) the pyrite-containing material as another flotation output.

3. The method defined in claim 2 wherein, before the flotation step, the pyrite removal step (a) includes a size separation step which separates larger particles in the pyrite-containing material from the remaining pyrite-containing slurry, with the remaining pyrite-containing slurry being transferred to the flotation step.

4. The method defined in claim 3 wherein the pyrite removal step (a) includes reducing the size of the larger particles in the pyrite-containing material in a size reduction circuit to form reduced-sized particles and returning the reduced-sized particles to the size separation step.

5. The method defined in claim 3 wherein the pyrite removal step (a) includes selecting the operating conditions so that pyrite particles in the pyrite-containing material in the remaining pyrite-containing slurry have a required particle size distribution for the downstream leach step (b).

6. The method defined in claim 1 wherein pyrite particles in the pyrite-containing material have a particle size of $P_{80}$ of 1 mm or a value <1 mm.

7. The method defined in claim 6 wherein the pyrite particles in the pyrite-containing material have a particle size of $P_{80}$ of 250 μm or a value <250 μm.

8. The method defined in claim 1 wherein the pyrite removal step (a) includes thickening and/or filtering the pyrite-containing material and forming a pyrite-containing concentrate.

9. The method defined in claim 1 includes using the inert stream as a source of water in processing plants for recovering metal from the metal sulfide-containing material.

10. The method defined in claim 1 wherein the metal is copper and the metal sulfide-containing material is a copper sulfide mineral.

11. The method defined in claim 10 wherein pyrite is 1-10 wt. % of the total mass of the copper sulfide-containing material and the pyrite-containing material.

12. The method defined in claim 1 includes mixing together the metal sulfide-containing material and the pyrite-containing material before the leaching step (b).

13. The method defined in claim 12 wherein the leaching step (b) includes:

i. agglomerating the pyrite-containing material and the metal sulfide-containing material, such as copper sulfide containing material, and forming agglomerates; and ii. heap leaching the metal, such as copper, from a heap of the agglomerates and producing a pregnant leach liquor containing the metal, such as copper, in solution; and iii. recovering the metal, such as copper, from the pregnant leach liquor.

* * * * *